US005685281A

United States Patent [19]

Li

[11] Patent Number: 5,685,281

[45] Date of Patent: Nov. 11, 1997

[54] GAS VORTEX DEVICE FOR INTERNAL COMBUSTION ENGINE

[76] Inventor: Yuan Li, 1136a Vega St., Alhambra, Calif. 91801

[21] Appl. No.: 635,663

[22] Filed: Apr. 22, 1996

[51] Int. Cl.[6] ..... F02M 29/00

[52] U.S. Cl. ..... 123/590; 123/592

[58] Field of Search ..... 123/590, 592, 123/593

[56] References Cited

U.S. PATENT DOCUMENTS

| | | | |
|---|---|---|---|
| 3,544,290 | 12/1970 | Larson, Sr. et al. | 123/592 |
| 4,088,103 | 5/1978 | Brown | 123/593 |
| 4,088,104 | 5/1978 | Ibbott | 123/593 |
| 4,307,697 | 12/1981 | Ong | 123/593 |
| 5,113,838 | 5/1992 | Kim | 123/593 |

FOREIGN PATENT DOCUMENTS

| | | | |
|---|---|---|---|
| 494738 | 6/1928 | Germany | 123/592 |
| 176437 | 6/1935 | Germany | 123/592 |
| 2539609 | 3/1977 | Germany | 123/590 |
| 528529 | 6/1955 | Italy | 123/590 |
| 600079 | 11/1959 | Italy | 123/592 |

*Primary Examiner*—Erick R. Solis

*Attorney, Agent, or Firm*—David & Raymond; Raymond Y. Chan

[57] ABSTRACT

A gas vortex device for an internal combustion engine includes at least a guider body installed in a predetermined position of a flowing passage provided between an inlet chamber of a cylinder body and an exhaling end of an air inputting arrangement of the internal combustion engine. The guider body which has an inlet end and an outlet end installed in such a manner that the outlet end should be more proximate to the inlet chamber of the cylinder body than the inlet end. The guider body further has an axial portion and at least two guiding wings extending symmetrically, outwardly and radially from the axial portion. Therefore, a gas mixture including the air and the atomized fuel that are sucked into the flowing passage from the air inputting arrangement are forced to flow through the guider body, inhaling through the inlet end and exhaling from the outlet end thereof before sucking into the inlet chamber of the cylinder body, so that the gas flow is guided by the guiding wings to spin and speed up such whirling motion. Therefore the gas mixture sucking into the inlet chamber of the cylinder body is spinning continuously in vortex form, so as to further atomize the atomized fuel particles to more diminutive tiny particles and more evenly and completely mix the air and atomized fuel particles.

4 Claims, 11 Drawing Sheets

GAS VORTEX DEVICE FOR INTERNAL COMBUSTION ENGINE

BACKGROUND OF THE PRESENT INVENTION

The present invention relates to an internal combustion engine, and more particularly to a gas vortex device for the internal combustion engine, which can completely and evenly mix the gas, including the air, the atomized particles of fuel and the residual fuel not completely combusted, within a transmittal passage between an air inputting arrangement and a cylinder body of the internal combustion engine. The gas vortex device can further atomize and minimize the atomized particles of the fuel and maintain the spinning motion of the atomized particles of the fuel after entering the cylinder body for continuously mixing with the residual gas left in the cylinder body, so as to ensure a more complete combustion and enhance the combustion explosiveness and the efficient of the internal combustion engine.

Accordingly, automobile's internal combustion engine has two types, one using gasoline as fuel called reciprocating engine and the other using diesel as fuel called diesel engine. Gasoline engine ignites combustion expansion by means of electric ignition to actuate the engine. The diesel engine provides high pressure to increase the temperature for igniting the explosiveness of the engine.

Normally speaking, as shown in FIG. 1, the dynamic principle of a carburetor fuel-line internal combustion engine is to transmit fuel from an oilpan to a carburetor 11 via a fuel-line hose. The carburetor 11 has an exit passage 12 in a lower portion and an air inputting arrangement 24 such as an air cleaner in an upper portion. A cylinder body 21 has an inlet chamber 22 which is connected with the exit passage 12 of the carburetor 11 via an inlet manifold 23. Utilizing the repetitious linear motion of a piston 25 within the cylinder body 21 and the relative opening and closing movement of an inlet valve 211 and an exhaust valve 212 in the cylinder body 21, during the ignition explosiveness moment of the fuel combustion process, i.e. the intaking, compression, exhaustion, and explosiveness of the fuel gas, the interior of the cylinder body 212 will generate a great suction force for sucking in air from the air inputting arrangement via the inlet manifold 23. The inblowing air will atomize the combustion fuel in the carburetor 11 which is injected into the cylinder body 21 in form of atomized particle. Substantially, the atomized fuel and the air can only partially mix during such sucking action before delivering to the cylinder body 21 through the inlet manifold 23. A plurality of spark plugs are installed in a head portion of the cylinder body 21 for generating the electric sparks to ignite the explosiveness of the fuel gas in order to push the piston 25 to move in repetitious linear motion to generate dynamic power. There would be some residual fuel gas exiting through the exhaust valve 212. A small portion of the residual fuel gas will be retrieved to the carburetor 11 through an exhaust recirculating valve and mixed with the inhaling atomized fuel and air for another combustion.

As shown in FIG. 2, a typical fuel injection internal combustion engine is illustrated, which dynamic principle is similar to the above mentioned carburetor fuel-line internal combustion engine, except that the fuel injection internal combustion engine has an injector 12 which replaces the carburetor arrangement installed around the inlet chamber 22 of the cylinder body 21. Therefore, the fuel is atomized and delivered to the cylinder body 21 by means of the injection of the injector 12. The inlet manifold 23 is also provided to connect the inlet chamber 22 of the cylinder body 21 with the air cleaner 24 for air delivery.

Nevertheless, whether the internal combustion engine is the carburetor fuel-line internal combustion engine or the fuel injection internal combustion engine, the mixing of the atomized fuel, air and residual gas from the exhaust valve 212 is very limited and merely happened while the air inhaling through the carburetor 11 to blow and atomize the fuel by means of the suction force caused by the repetition linear motions of the piston 25 within the cylinder body 21. Hence, a complete and even mixing of the atomized fuel and the air does not come close if it is only relied on such air inhaling procedure as mentioned above. It is well known that the smaller the atomized fuel particle becomes and the better fuel combustion effectiveness can be achieved. Moreover, the more complete and even mixing of the atomized fuel and the air, the more complete combustion is resulted. Therefore, the horsepower of the internal combustion engine will increase and the amount of carbon monoxide in the residual gas exhausted to the atmosphere due to incomplete combustion will decrease.

Due to the limited interior space of the typical internal combustion engine, the mixing of the atomized fuel and the air still has a long way to go. All the car manufacturers concentrate their design in the performance of the air cylinder or the transmission coupling. Their common objective is to enhance the explosiveness of the internal combustion engine, to increase horsepower, and to conserve fuel. Various kinds of engine were created. However, the problem of incomplete combustion of fuel is still existed that it leads to residual gas and creats carbon monoxide. This is very harmful to our environment and it is a waste of our fuel energy. In fact, in conventional automobile's internal combustion engines, more than 40% of them have the problem of incomplete fuel combustion that exhausts polluting and harmful gases, such as carbon monoxide, to the air.

In order to enhance horsepower and decrease air pollution, most of the automobile manufacturers try hard to improve their design of the cylinder body and exhausting mechanism. The result is promising. In fact, in order to solve the problem of incomplete combustion of fuel that leads to decrease in horsepower and air pollution, one needs to start from the root. The solution is to increase the atomization of fuel so as to provide more minified fuel particles and mix the atomized fuel with air more completely, so that the combustion of the atomized fuel and the air will be more completely to enhance the power and performance of the internal combustion engine.

SUMMARY OF THE PRESENT INVENTION

The main object of the present invention is to provide a gas vortex device, which is installed in an internal combustion engine positioning between a cylinder body and an air inputting arrangement, capable of increasing the spinning speed of gas flow in the inlet chamber of the cylinder body of the internal combustion engine so as to ensure a more complete combustion of the fuel. Accordingly, the fuel, the air and a small portion of the residual gas that hasn't exhausted from the cylinder body can be more evenly mixed to enhance complete combustion and explosiveness, thereby increasing the efficiency of the internal combustion engine, conserving fuel, and decreasing the mount of carbon monoxide in the residual gas exhausted from the engine.

Another object of the present invention is to provide a gas vortex device for an internal combustion engine, which renders the gas flowing into the cylinder body into a spinning vortex which would continue to spin within the cylinder body's inlet chamber so as to further atomize the fuel particles to be more diminution for enhancing the fuel combustion of the internal combustion engine.

Accordingly, a gas vortex device for an internal combustion engine according to the present invention comprises at least a guider body installed in a predetermined position of a flowing passage provided between an inlet chamber of a cylinder body and an exhaling end of an air inputting arrangement of the internal combustion engine. The guider body which has an inlet end and an outlet end installed in such a manner that the outlet end should be more proximate to the inlet chamber of the cylinder body than the inlet end. The guider body further has an axial portion and at least two guiding wings extending symmetrically, outwardly and radially from the axial portion. Moreover, each of the guiding wing is a flat plate symmetrically extending and bending from the inlet end to the outlet end of the guider body with a predetermined angle. Therefore, a gas mixture including the air and the atomized fuel that are sucked into the flowing passage from the air inputting arrangement are forced to flow through the guider body, inhaling through the inlet end and exhaling from the outlet end thereof before sucking into the inlet chamber of the cylinder body, so that the gas mixture is guided by the guiding wings to spin and speed up such whirling motion. Therefore the gas mixture sucking into the inlet chamber of the cylinder body is spinning continuously in vortex form, so as to further atomize the atomized fuel particles to more diminutive tiny particles. Such whirling gas flow will generate a stirring effect to more completely and evenly mix the atomized fuel particles, the air and a small portion of residual gas which is formed by incomplete combustion and hasn't exhausted from the inlet chamber of the cylinder body. Accordingly, the internal combustion engine's and the horsepower would also increases. It means that the efficiency of the internal combustion engine is improved. Furthermore, as a result, the consuming fuel will decrease and the mount of carbon monoxide in the residual gas exhausted from the internal combustion engine will also decrease.

DETAILED DESCRIPTION OF THE PREFERRED EMBODIMENT

Figure 3:
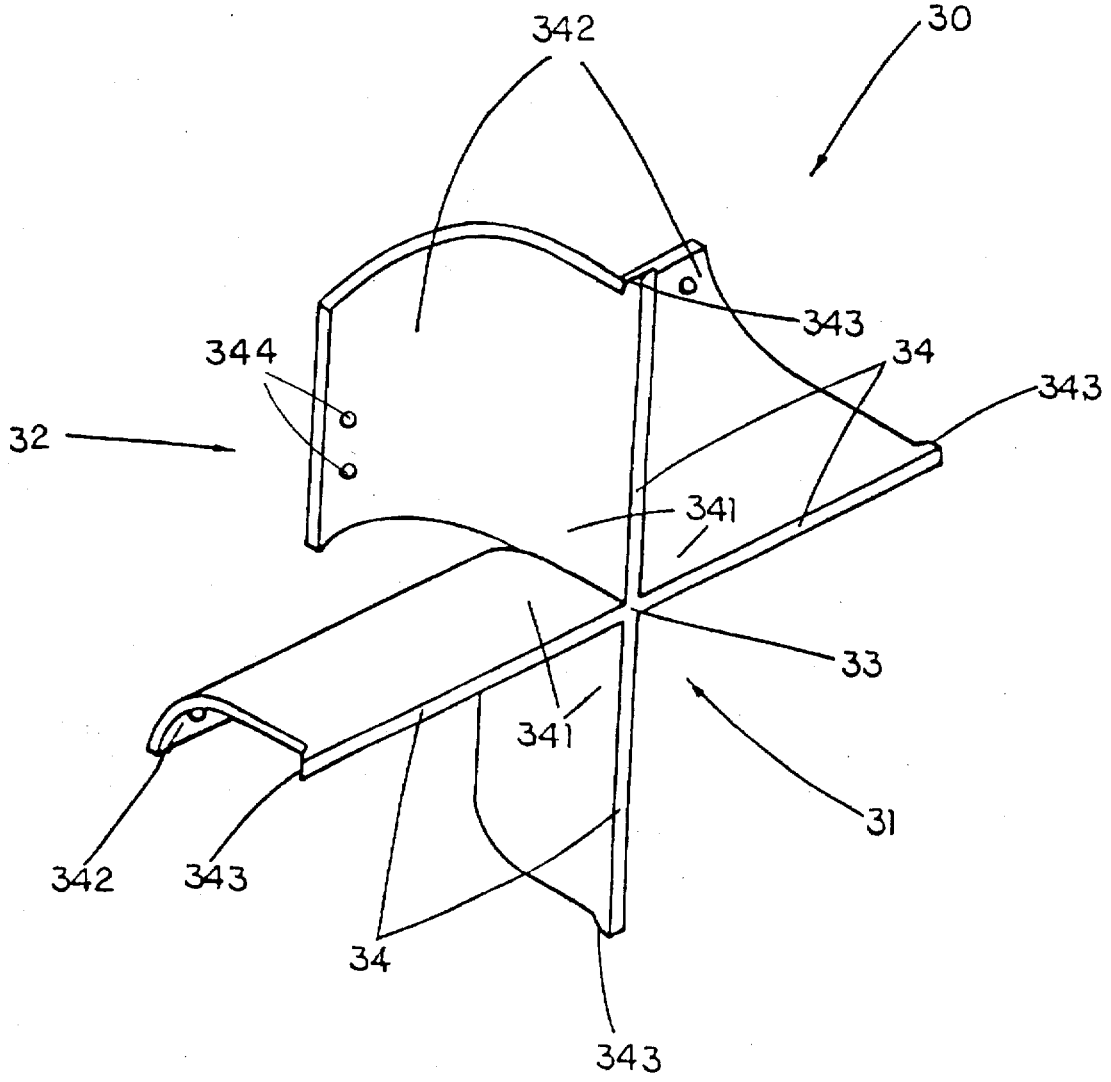
FIG. 3 is a front perspective view of a guider body of a gas vortex device for internal combustion engine according to a preferred embodiment of the present invention.
Figure 4:
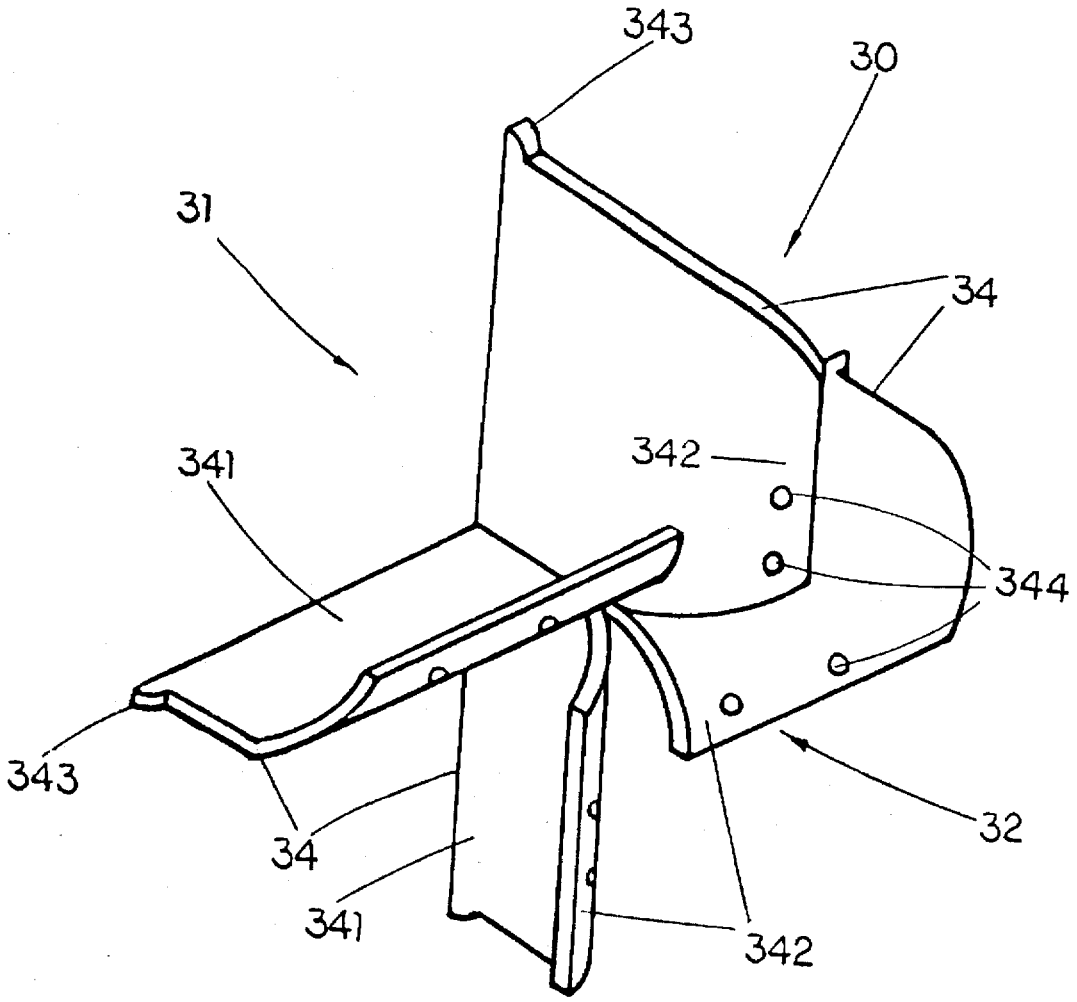
FIG. 4 is a rear perspective view of the guider body according to the above preferred embodiment of the present invention.
Figure 5:
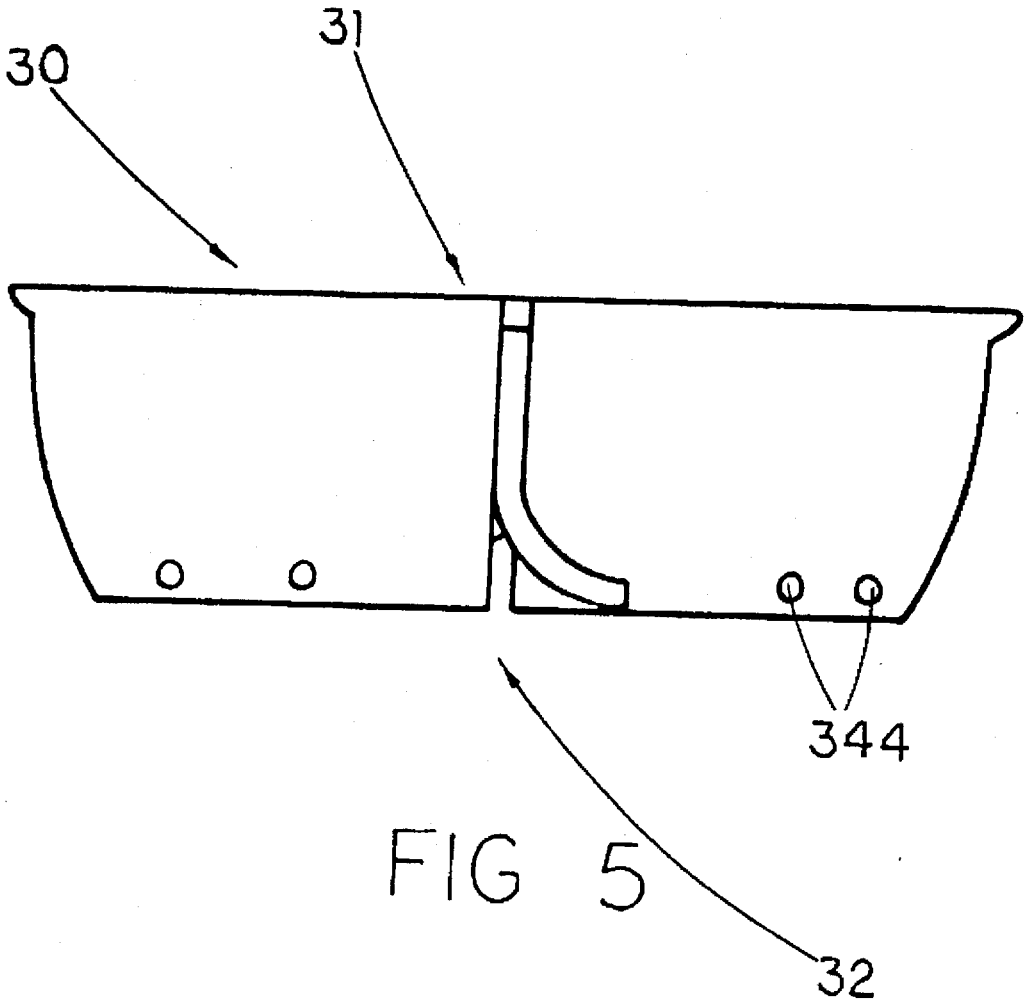
FIG. 5 is an end view of the guider body according to the above preferred embodiment of the present invention.

Referring to FIGS. 3, 4 and 5 of the drawings, a gas vortex device for an internal combustion engine of the present invention comprises a predetermined number of guider body 30 which has an inlet end 31 at one side and an outlet end 32 on the other side.

The guider body 30 has an axial portion 33 and at least two symmetrical guiding wings 34. According to the present embodiment, there are four symmetrical guiding wings 34. Each guiding wing 34 is a flat plate symmetrically, outwardly and radially extending from the axial portion. Each guiding wing 34 is symmetrically bent in a predetermined arcuate form, gradually extending from the inlet end 31 to the outlet end 32 of the guider body 30.

Each guiding wing 34 has a flat portion 341 and an inclined portion 342. The four flat portions 341 of the four guiding wings 34 of the guider body 30, which have same length and width, are connected with each other integrally and perpendicularly to form a cross shape and constitute the inlet end 31 of the guider body 30, as shown in FIG. 3. The four inclined portions 342 of the four guiding wings 34 of the guider body 30 are extended from four rear ends of the four flat portions 341 respectively and bent gradually in clockwise (or counterclockwise) manner to form an arc shape for constituting the outlet end 32 of the guider body 30. The incline angle of each inclined portion 342 can be from 30 degree to 80 degree, but the best preferred incline angle is between 50 to 60 degree. Therefore, each guiding wing 34 has a cross section in form of "J" (as shown in FIG. 4).

An outermost side of each flat portion 341 of each guiding wing 34 protrudes a supporting shoulder 343. The width of each inclined portion 342 of each guiding wing 34 is gradually decreased from the corresponding flat portion 341 to form a narrower tail end, as shown in FIG. 5, so as to enable the guider body 30 to be coaxially mounted in a predetermined position of a cylindrical inner wall of the following passage.

The guider body 30 is made of metal that can stand high heat and high pressure, such as stainless steel or harden alloy. It can be constructed integrally from one metal plate or by welding four "J" shaped metal pieces together. Of course, it can also be constructed with two identical rectangular metals by integrally connecting the two metals to form a cross form, wherein two symmetrical tail portions of each rectangular metal should be bent either forward or backwards to form an arcuate shape respectively.

In accordance with the theory of fluid mechanics, if a suction force is provided at the outlet end 32 of the guider body 30, the air would be sucked in from the inlet end 31 and forced to flow along the guiding wings 34. Due to the guidance of the arcuate guiding wings 34, the air flowing through the guider body 30 would be forced to spin and generate an accelerating vortical air flow from the outlet end 32 of the guider body 30. Such vortical air flow provides a stirring effect similar to the function of an electric juicer that can evenly mix up different fluid in it.

Moreover, since the inclined portions 342 of the guider body 30 are independently and and extended from the flat portions 341 respective the inlet end 31 and exhales from the outlet end 32, the gas flow may impact each inclined portion 342 and cause vibration. The vibrating inclined portions 342 of the guiding wings 34 induce the gas flow with a vibration wave which can further enhance the mixing effect of various kinds of gas. Especially during high speed driving of a vehicle where the suction rate of gas flow increases, the vibration wave induced by each vibrating inclined portion 342 will further diminish the atomized fuel particles.

In order to enhance the mixing ability of the guider body 30 of the present invention, the inclined portion 342 of each guiding wing 34 has at least one guiding hole 344 punctured thereon. According to the present embodiment, each guiding wing 34 has two guiding holes 344 punctured in different location, which may cause the gas flowing through the guider body 30 becomes a turbulence flow for further enhancing its mixing effect.

Figure 10:
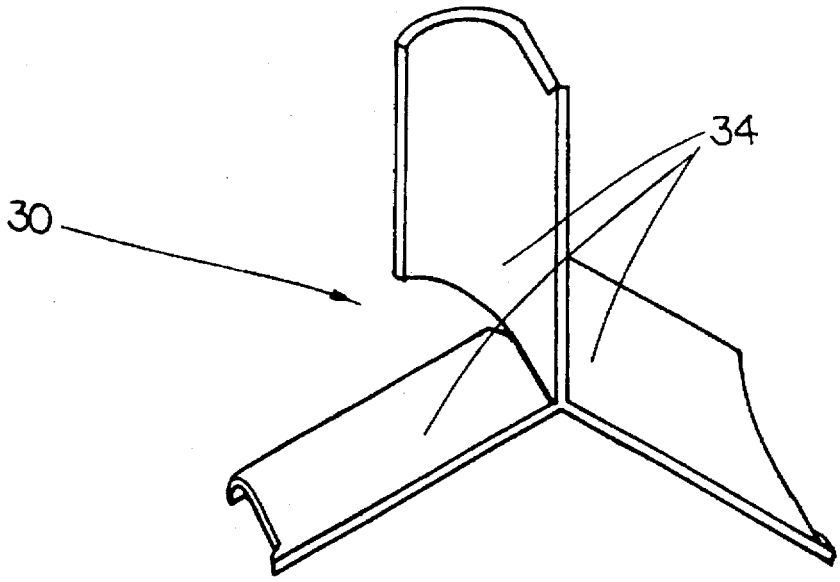
FIG. 10 is a perspective view of a guider body according to a second preferred embodiment of the present invention.

Referring to FIG. 10, a guider body 30 according to a second embodiment is illustrated, which comprises only three equally and angularly spaced pieces of the guiding wings 34 in form of a triangular shape. Each of the guiding wings 34 is constructed as in the above first embodiment to create vortical gas flow for evenly mixing the air and the atomized fuel. Basically, the total number of the guiding wing 34 of the guider body 30 can be more than ten. However, a guider body 30 having 3 to 5 pieces of guiding wing 34 can also achieve a similar gas mixing effect.

As described before, whether it is a gasoline fuel internal combustion engine, a diesel fuel internal combustion engine, a carburetor fuel-line internal combustion engine, or a fuel injection internal combustion engine, gas mixture including the air, the atomized fuel, and the small portion of residual gas formed by incomplete combustion is ignited to combust within a cylinder body of the internal combustion engine. If a better mixing of such gas mixture is desired, the gas mixture must be evenly mixed when it is inhaled into the cylinder body or even before inhaling into the cylinder body. Therefore, the gas vortex device for the internal combustion engine of the present invention is preferably installed in a predetermined position along a flowing passage provided between the cylinder body and an exhaling end of an air inputting arrangement of the internal combustion engine.

Figure 6:
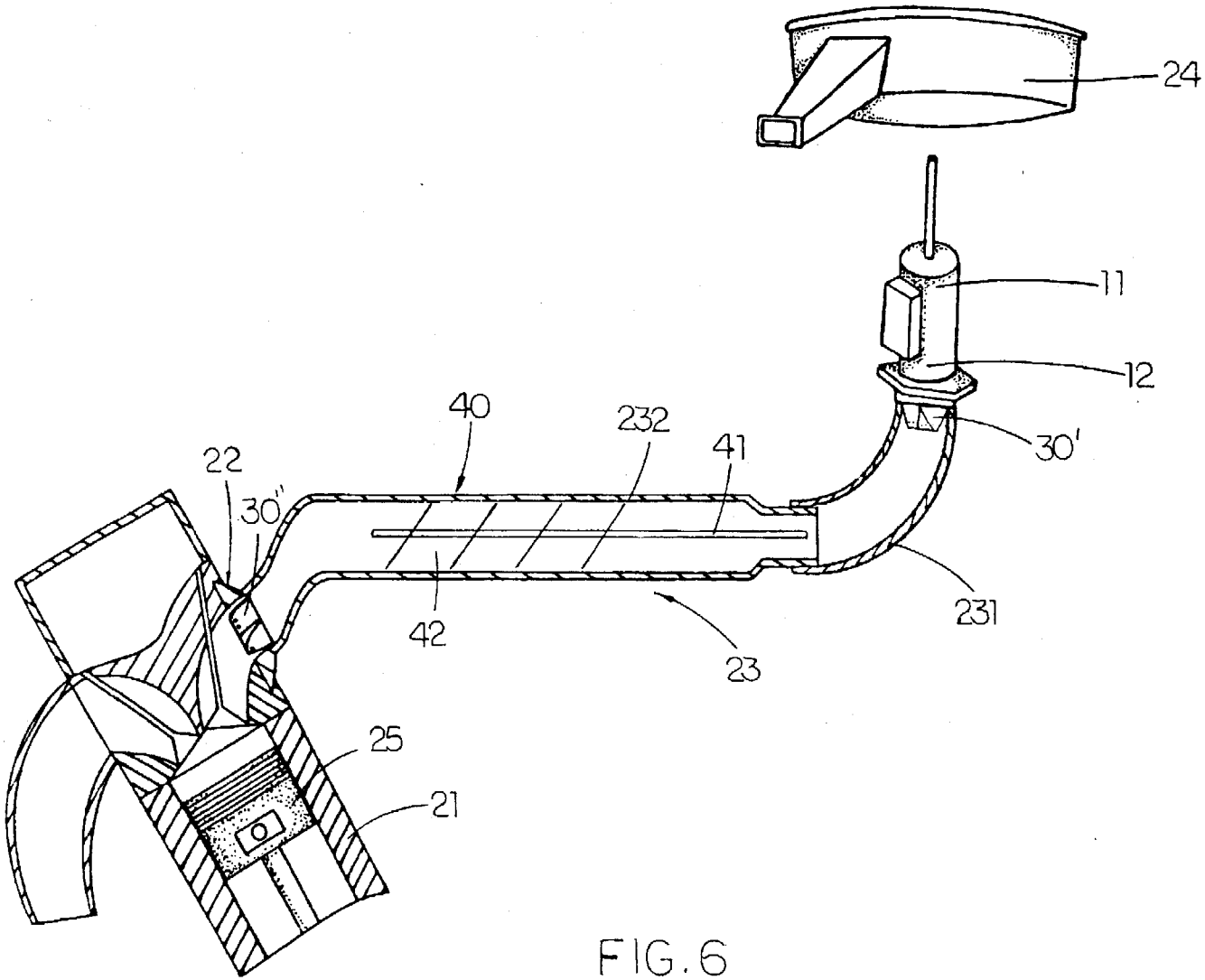
FIG. 6 is a partial and sectional schematic view illustrating the installation of the gas vortex device of the present invention in a carburetor fuel-line internal combustion engine.

As shown in FIG. 6, a partial and sectional schematic view of the installation of the gas vortex device of the present invention in a carburetor fuel-line internal combustion engine is illustrated. The flowing passage provided between the inputting arrangement 24 and the cylinder body 21 is constituted by an exit tube 12 of a carburetor 11, a predetermined number of inlet chambers 22 of the cylinder body 21, and an inlet manifold 23. The reciprocating movement of the piston 25 in the cylinder body 21 form a suction force to suck in air from the inputting arrangement 24 to the carburetor 11. The inhaling air can atomize the gasoline fuel in the carburetor 11 which will be sucked into the inlet manifold 23 with the air and the residual gas. Such gas mixture is sucked into the cylinder body 21 through each of the inlet chambers 22.

The gas vortex device for the internal combustion engine of the present invention comprises at least a guider body 30', as shown in FIG. 6, which is installed firmly and tightly in the inlet seat 231 of the inlet manifold 23 adjacent to the carburetor 11.

Figure 8:
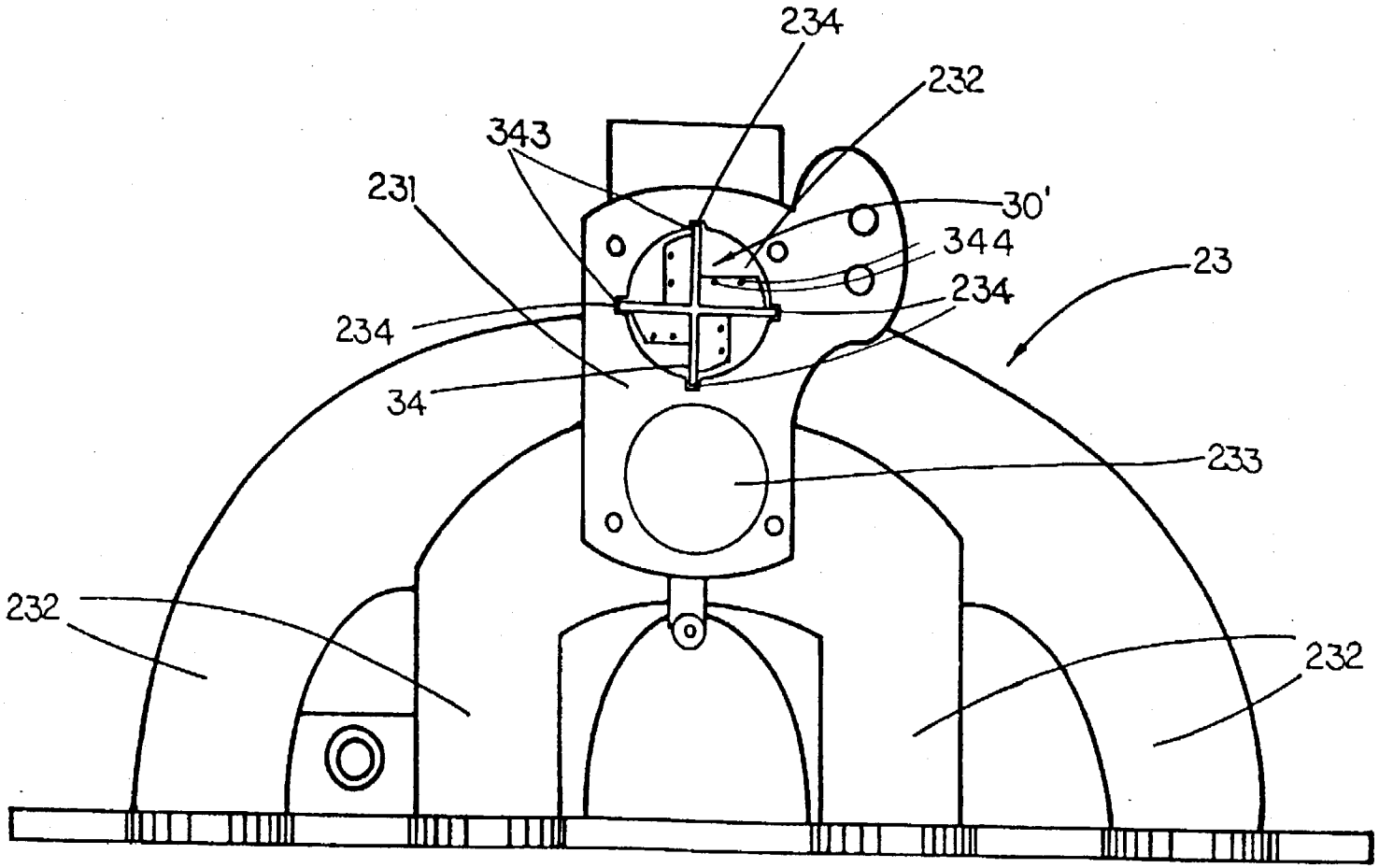
FIG. 8 is a partial top view of an inlet manifold illustrating the installation of the guider body of the present invention in an entrance opening of the inlet manifold.

As shown in FIG. 8, the inlet seat 231 of the inlet manifold 23 has a circular main inlet hole 232 and a high speed auxiliary inlet hole 233 thereon. A top circumference edge of the main inlet hole 232 provided four indentions 234 positioned evenly around the top circumference edge. The guider body 30' is firmly mounted on the main inlet hole 232, acting as a main guider body, by engaging the four supporting shoulders 242 of the four guiding wings 34 into the four indention 234. This main guider body 30' can also be installed in the main inlet hole 232 by various well known means as long as the securing force between the main guider body 30' and the main inlet hole 232 is stronger than the suction force existed near the main inlet hole 232.

According to the present embodiment, since the gas mixture is sucked to flow inwardly into the inlet hole 232, the main guider body 30' would be pressed firmly in position due to the engagement of the supporting shoulders 343 of the guiding wings 34 and the indentions 232 of the main inlet hole 232. It is worth to mention that the outlet end of the main guider body 30' must be located inside the main inlet hole 232, as shown in FIG. 8.

Therefore, as shown in FIGS. 6 and 8, all the inhaling air and atomized fuel are forced to pass through the main guider body 30' for entering the inlet manifold 23 to flow to the inlet chamber 22 of the cylinder body 21. It means that all the air and atomized fuel are forced to pass through the main guider body 30' via its inlet end 31. The gas mixture of the air and the atomized will be guided to spin and accelerate by the guiding wings 34 of the main guider body 30' to form a strong vortical gas flow. Such vortical gas flow generates a stirring effect to mix the air and the atomized fuel more evenly and completely so as to further atomize the atomized fuel particles. The whirling current created by the vortical gas flow can cause the gas mixture flowing into the cylinder body 21 and remains spinning, so as to ensure the combustion in the cylinder body 21 being more completely.

Figure 9:
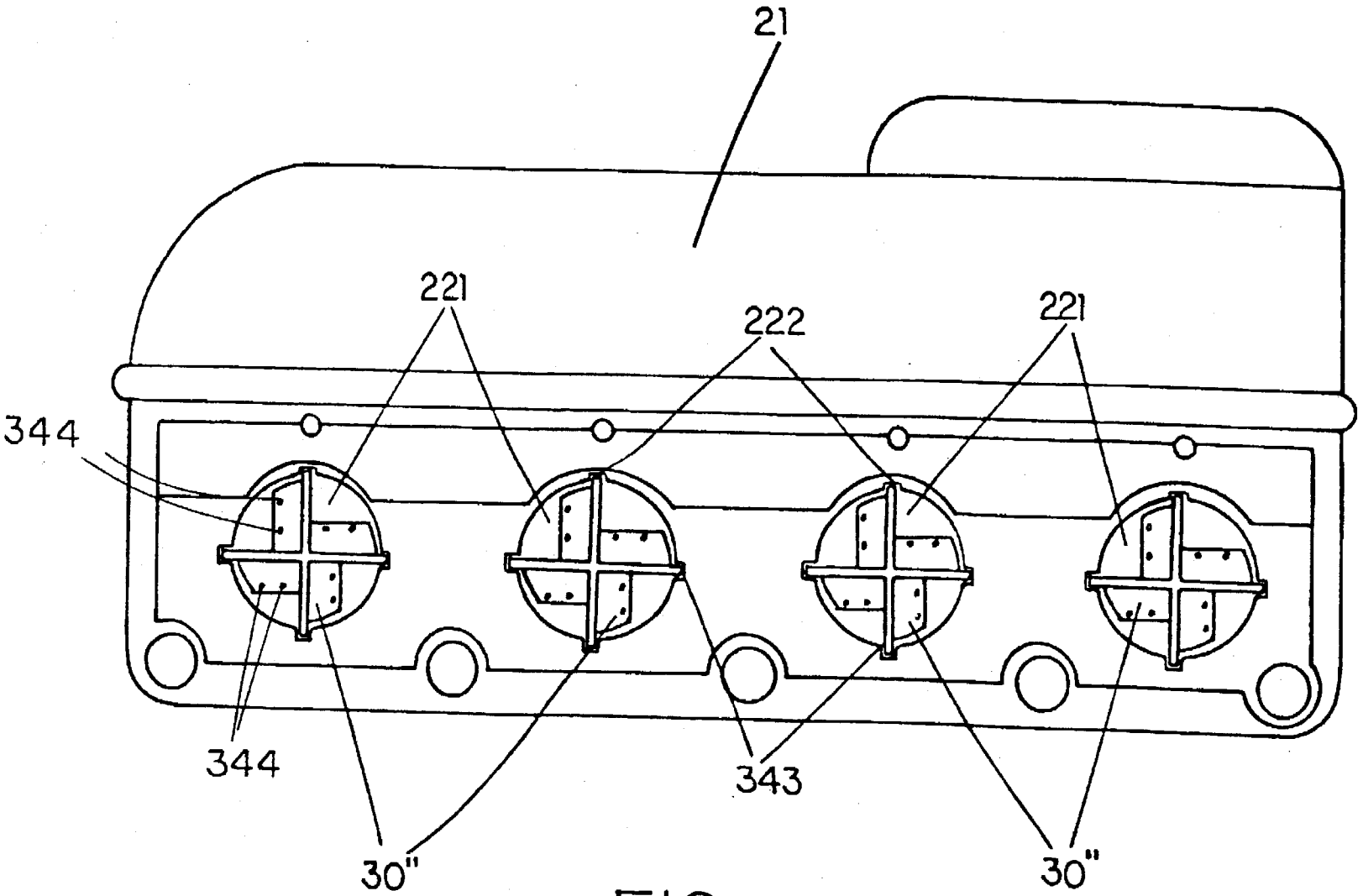
FIG. 9 is a partial front view of the internal combustion engine illustrating the installation of the guider body of the present invention in the entrances of the inlet chambers of the cylinder.

In order to enhance the continuation and the power of the vortical gas flow for achieving a more even and complete mixing effect, as shown in FIG. 6 and FIG. 9, the gas vortex device for the internal combustion engine further comprises a plurality of the guider bodies 30" adapted to selectively install in a plurality of circular entrance openings 221 of the inlet chambers 22 of the cylinder body 21 respectively. The top circumference of each entrance opening 221 forms four indentions 222 for engaging with the four supporting shoulders 343 of each of the guiding wings 34 in order to hold the respective guider body 30" firmly in position. Moreover, the guider bodies 30" can be further secured in position by the locking pressure of the tail end of the inlet manifold 23 when it is secured to the cylinder body 21 (not shown in Figures). Therefore, for a four-cylinder internal combustion engine, there are four guider bodies 30" installed in its four entrance openings 221 respectively. For a six-cylinder internal combustion engine, it's best to install six guider bodies 30" in its six entrance openings 221 respectively. Of course, one can only select a predetermined entrance opening 221 to install the guider body 30", wherein a certain level of gas mixing effect can still be achieved.

Therefore, the vortical gas flow generated by the main guider body 30', as shown in FIG. 6, can be enhanced by the additional installment of the guider bodies 30" in the inlet chambers 22 of the cylinder body 21. The whirling motion of the air and the atomized fuel inhaled into the inlet chambers 22 can then be further accelerated and enhanced, so that the air, the atomized fuel and the residual gas formed by incomplete combustion within the inlet chambers 22 can be completely and evenly mixed. The atomized fuel particle will also be further diminished and thus enhance the complete combustion in the cylinder body 21, resulting in enhancement of the horsepower and conservation of gas fuel. Of course, according to the present invention, one can only mount the guider bodies 30" on the entrance openings 221 of the inlet chambers 22 of the cylinder body 21 respectively, the resulting mixing effect of gas mixture being also very obvious and successful.

Figure 11:
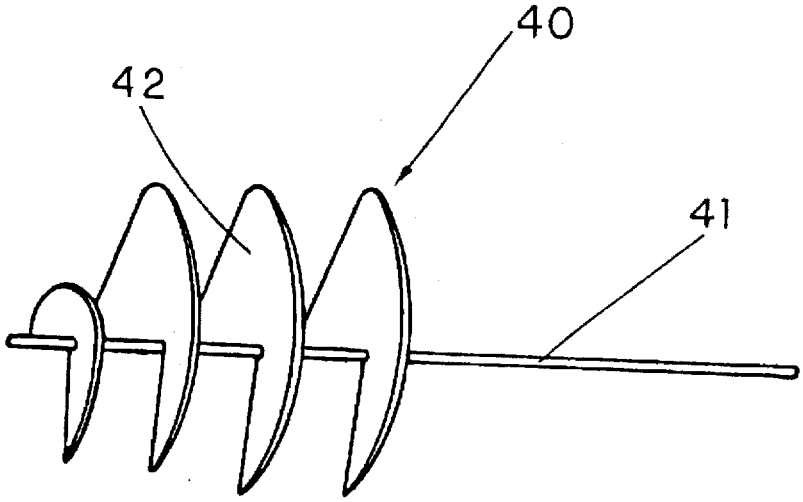
FIG. 11 is a perspective view of an auxiliary guider of the present invention.

Referring to FIG. 6 and FIG. 11, the gas vortex device for the internal combustion engine of the present invention further comprises at least an auxiliary guider 40, which comprises a flexible guide rod 41 and a spiral guide wing 42. The spiral guide wing 42 is in spiral form and connects to the guide rod 41. A tail end of the auxiliary guider's 40 guide rod 41 is connected to one end of the inlet manifold 23. The spiral guide wing 42 is extended inside on the corresponding inlet manifold 23. Therefore the vortical gas flow inside the inlet manifold 23 can thus be further conducted to spin for better mixing of the air and the atomized fuel inside the inlet manifold 23.

Figure 7:
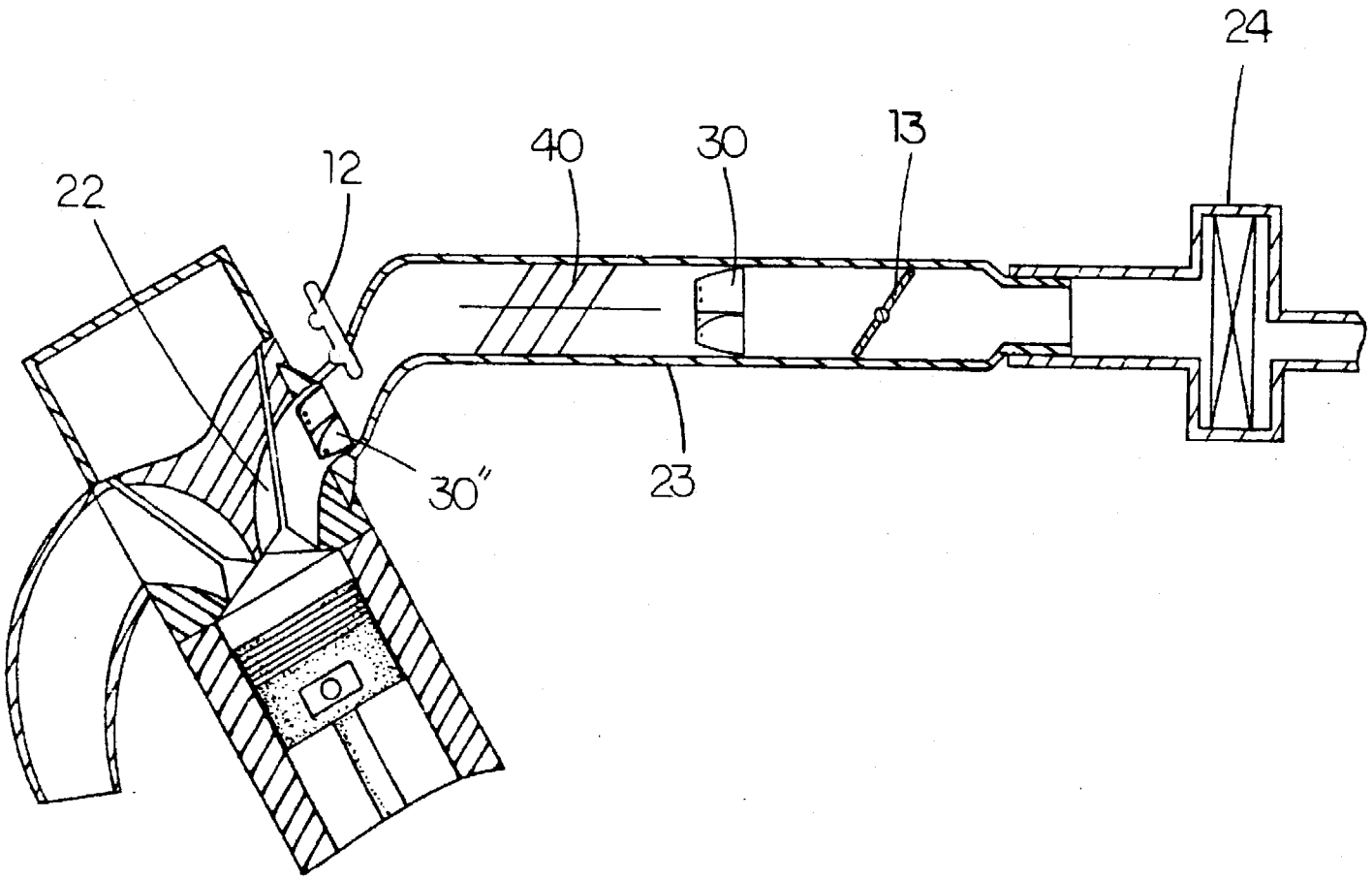
FIG. 7 is a partial and sectional schematic view illustrating the installation of the gas vortex device of the present invention in a fuel injection internal combustion engine.

Referring to FIG. 7, a partial and sectional schematic view of the installation of the gas vortex device of the present invention in a fuel injection internal combustion engine is illustrated. The fuel injection internal combustion engine doesn't provided any carburetor but an injector 12 is installed adjacent to the inlet chamber 22 of the cylinder body 21. The injector 12 injects atomized fuel particles which are sucked into the inlet chambers 22. Besides, between the inputting arrangement 24 and the inlet manifold 23, an air inleting speed control valve 13 is installed. In this embodiment, the main guider body 30' is installed right after the air inleting speed control valve 13 in the inlet manifold 23 with the outlet end 32 of the main guider body 30' more proximate to the cylinder body 21. Accordingly, the air inhaled in the inlet manifold 23 will be forced to generate a vortical flow by means of the main guider body 30' for evenly and completely mixing with the atomized fuel flowing from the injector 12 to the cylinder body 21. Furthermore, the atomized fuel particles will also be further diminished by such vortical flow. As described in the previous embodiment regarding to the carburetor fuel-line internal combustion engine, a predetermined number of the guider bodies 30" are installed in the inlet chambers 22 of the cylinder body 21 and at least an auxiliary guider 40 is installed in the inlet manifold 23.

Figure 12A:
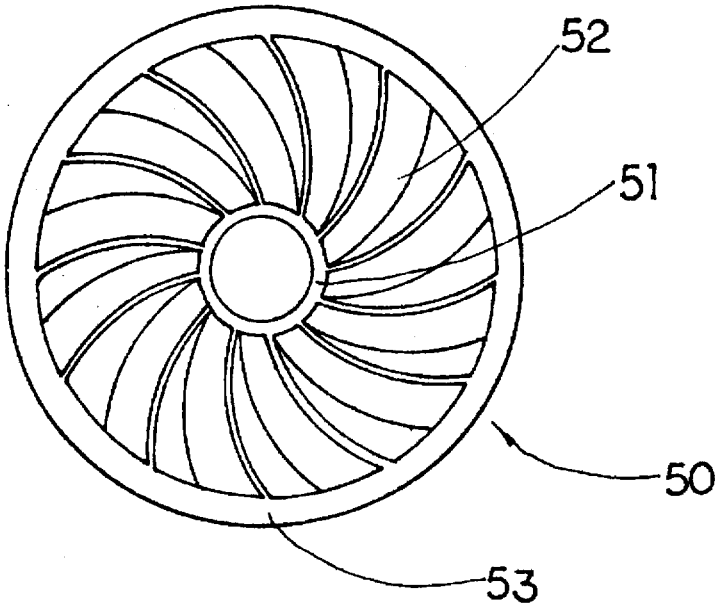
FIG. 12A is a plan view of a guider body according to a third preferred embodiment of the present invention.
Figure 12B:
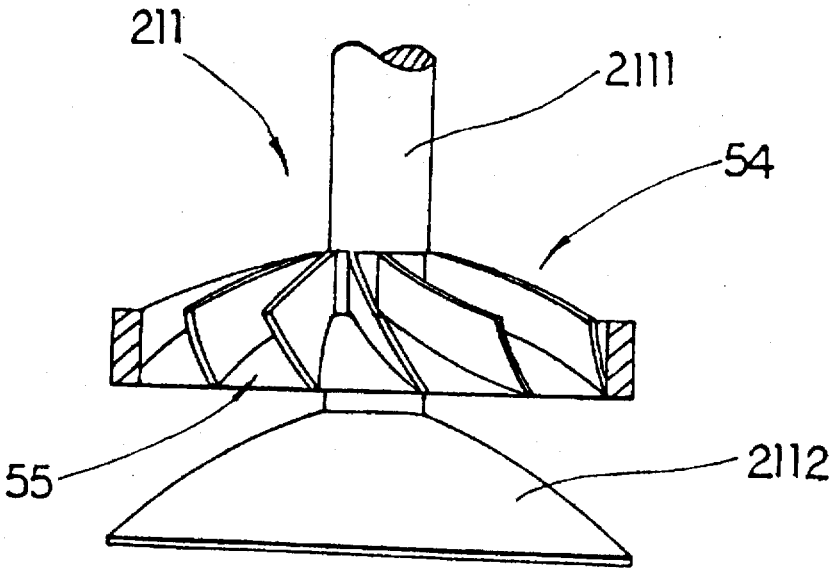
FIG. 12B is an end view of the guider body as shown in FIG. 12A incorporating with a cylinder inlet valve.

Referring to FIG. 12A and FIG. 12B, a third preferred embodiment of a guider body 50 of the gas vortex device for the internal combustion engine of the present invention is illustrated. The guider body 50 comprises an axial portion 51 and a plurality of guiding wings 52. The axial portion 51 is in ring form, and each of the guiding wings 52 is equally spaced and extended from the axial portion outwardly with a predetermined length in fan paddle pattern. An outer ring 53 is attached to a tail end of each the guiding wing 52. Since the axial portion 51 and the outer ring 53 are concentrically positioned at different planes, the arcuate guiding wings 53 connected between the axial portion 51 and the outer ring 53 constitutes a bowl shape construction having a convex top surface and a concave bottom surface. The convex top surface acts as an inlet end inlet end 54 and the concave bottom surface acts as an outlet end 55. When air is inhaled in the inlet end 54 and passes through the plurality of guiding wings 52, the air is forced to spin and generate a vortical air flow exhaling from the outlet end 55.

Figure 1:
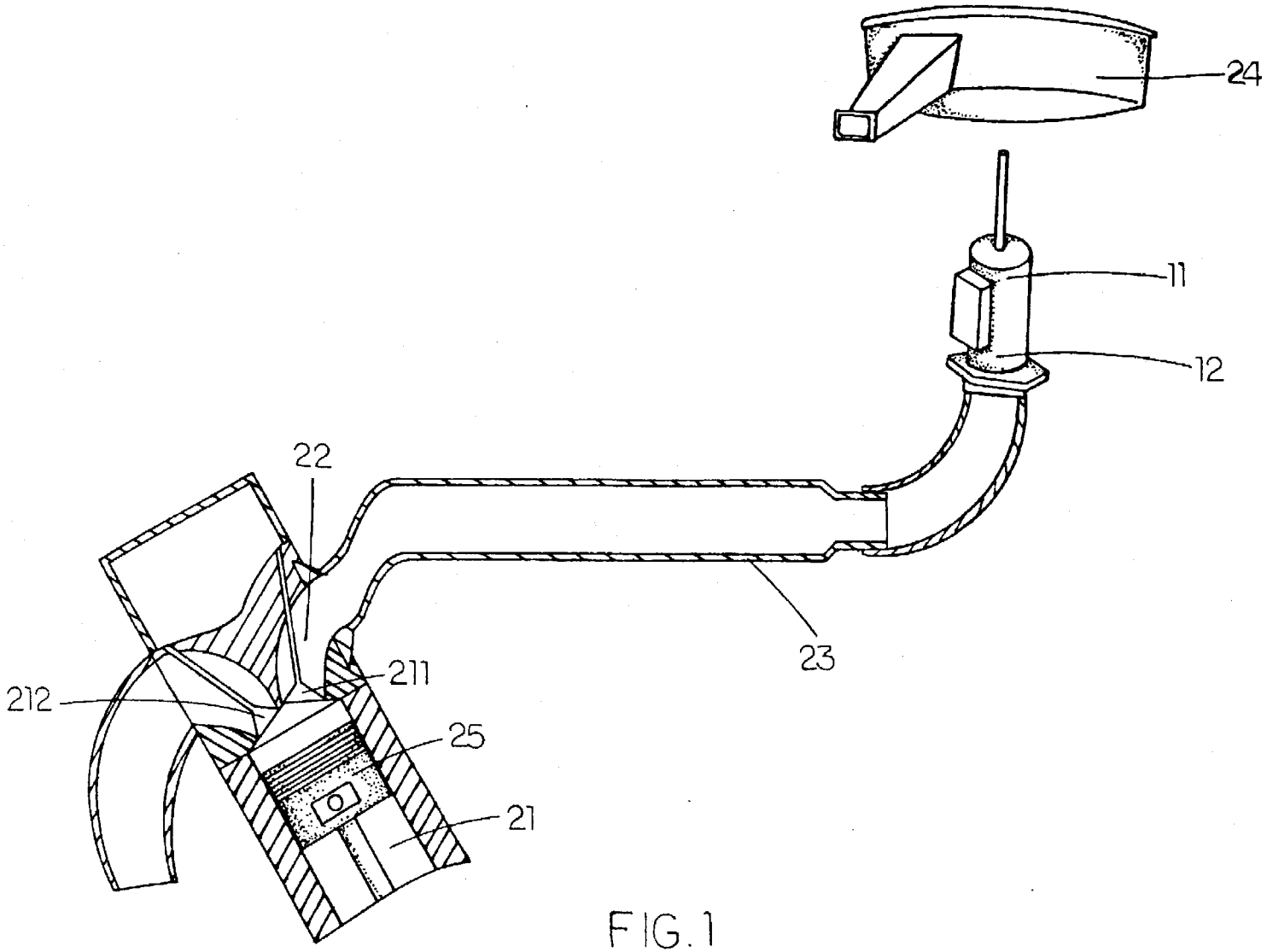
FIG. 1 is a partial and sectional schematic view of a conventional carburetor fuel-line internal combustion engine.
Figure 2:
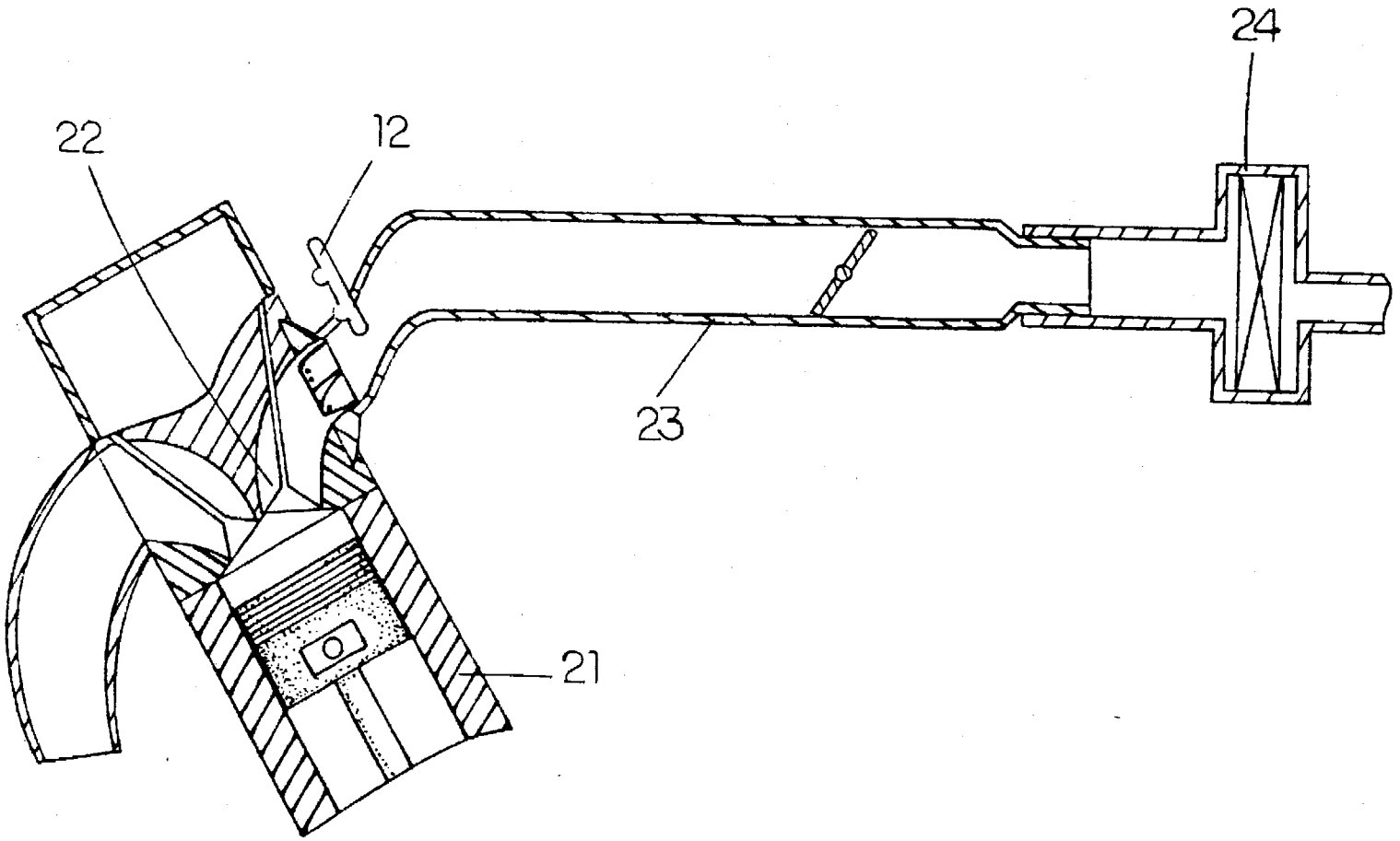
FIG. 2 is a partial and sectional schematic view of a conventional fuel injection internal combustion engine.

Referring to FIG. 12B, an inhaling vane 211 (as shown in FIGS. 1 and 2) comprises a valve pole 2111 and a vane 2112 attached to the bottom end of the valve pole 2111. The guider body 50 is mounted on a base portion of the valve pole 2111 adjacent to the valve 2112, in which the valve pole 2111 is just fitted to firmly engage with the axial portion 51 of the guider body 50. Of course, it's best to have the guider body 50 integrally molded with the inhaling valve 211 in one body manner.

Therefore, when the inhaling valve 211 is driven to move up and down, the guider body 50 moves with the inhaling valve 211 synchronously. The gas mixture of air and atomized fuel is forced to flow through the guider body 50 due to the suction force generated by the reciprocal movement of the piston 25 in the cylinder body 21. Such gas mixture will be forced to whirl and generate a vortical flow by the guiding of the guiding wings 52 of the guider body 50 when inhaling into the cylinder body 21, which is continuously spinning for ensuring a next even and complete combustion explosion in the cylinder body 21. Due to the present of the guider body 50, the air and the atomized fuel entered the cylinder body 21 is evenly mixed and the atomized fuel particles can be further diminished for achieving more complete combustion so as to conserve fuel, increase horsepower and reduce the amount carbon monoxide in the exhausted residual gas.

The size of the guider body 50 is designed according to different automobile's inhaling valve's shape and size. The number and curvature of the guiding wings 52 also depend on the design of automobile's cylinder capacity. But the incline angle of each guiding wing 52 should be best designed between 30 degree to 45 degree.

It is worth to remind that even though the gas vortex device for the internal combustion engine of the present invention only comprises one main guider body 30' installed in the inlet seat 231, it can still create the advantages listed below.

1) The function of the present invention is to more evenly and completely mix the gas mixture, including the air, the atomized fuel and the residual gas formed by incomplete combustion, which is flowing in the flowing passage provided between the internal combustion engine's inputting arrangement and the cylinder body. Moreover, the atomized fuel particles would be further diminished and combine with the residual gas left in the cylinder body again due to the continuously whirling motion of the gas mixture in the cylinder body for enhancing the explosiveness of combustion. Thus the efficiency of the internal combustion engine is enhanced as well.

2) When a gas vortex device of the present invention is equipped with an internal combustion engine, the emission of the carbon monoxide exhausted from the internal combustion engine is lessened. The pollution that the automobile cause to the environment would decrease. The usage efficiency of fuel is enhances. The efficiency of the internal combustion engine for whether gasoline fuel or diesel fuel is enhanced also.

3) The guider body of the present invention can be composed of two pieces, three pieces, four pieces, or even many pieces of the guiding wing. The guiding wings are capable of having different arc or incline degree, but all of the guiding wings must be inclined and extended in the same direction in order to achieve best vortex effect. The incline angle of such guiding wing is best to incline between 50 to 60 degree, in which the larger the incline angle, the better whirling motion can be achieved but the air resistance would also increase. Moreover, when the incline angle is smaller, the whirling effect and the air resistance would decrease.

4) The gas vortex device for the internal combustion engine of the present invention can be incorporated with a normal gasoline or diesel automobile that has been running for few years. The horsepower of its internal combustion engine may increase 7.4% to 14% or more. (For brand new vehicle, 15% or more is possible). The consumption of fuel may decrease 15% to 31%. (For brand new vehicle, it is even better) Also the emission of the carbon monoxide may decrease about 20%.

5) With the installation of the present invention, the internal combustion engine of the vehicle can conserve fuel and reduce air pollution when running under either lower speed, moderate speed, or high speed.

I claim:

1. A gas vortex device for an internal combustion engine, comprising at least a guider body installed in a predetermined position of a flowing passage provided between a cylinder body and an exhaling end of an air inputting arrangement of said internal combustion engine, wherein said guider body, which has an inlet end and an outlet end, is installed in a manner that said outlet end is more proximate to an inlet chamber of said cylinder body than said inlet end, said guider body further having an axial portion and at least two guiding wings extending symmetrically, outwardly and radially from said axial portion, wherein each of said guiding wings is a flat plate symmetrically extending and bending from said inlet end to said outlet end of said guider body with a predetermined angle to form a flat portion and an inclined portion, said flat portion of each said guiding wing having a same length and width to constitute said inlet end of said guiding body and said inclined portion of each said guiding wing being extended from a rear end of said corresponding flat portion and bent gradually to form an inclined arc shape to constitute said outlet end of said guiding body, each said inclined portion of said guiding wings gradually decreasing a width thereof from said corresponding flat portion to form a narrower tail end so as to enable said guider body to be coaxially mounted on a predetermined position of said flowing passage, said flowing passage having a cylindrical inner wall and being constituted by an exit tube of a carburetor which is mounted underneath said air inputting arrangement, a predetermined number of inlet chambers of said cylinder body and an inlet manifold for connecting said exit tube with said inlet chambers, said inlet manifold having an inlet seat connected with said exit tube, said inlet seat having a circular main inlet hole provided thereon and said guider body being installed in said main inlet hole of said inlet seat of said inlet manifold, each said inlet chamber of said cylinder body having a circular entrance opening which top circumference forms four equally spaced indentions, a predetermined number of said guider bodies being installed in said inlet chambers respectively by engaging said four supporting shoulders of said four guiding wings of each said guider body in said four indentions of said circular entrance opening of each said inlet chamber, an outermost side of each said flat portion of each said guiding wing protruding a supporting shoulder, a top circumference edge of said main inlet hole providing a predetermined number of indentions positioned evenly around said top circumference edge for engaging with said supporting shoulders of said guiding wings respectively so as to firmly and tightly secure said guider body in said inlet seat of said inlet manifold, thereby a gas mixture including air and atomized fuel particles that are sucked into said flowing passage, from said air inputting arrangement are forced to flow through said guider body, inhaling through said inlet end and exhaling from said outlet end of said guider body, so that said gas mixture is guided by said guiding wings to spin and exhaled from said outlet end in form of vortical flow, so as to further diminish said atomized fuel particles and mix said air and said atomized fuel particles more completely and evenly.

2. A gas vortex device for an internal combustion engine, as recited in claim 1, in which said guider body comprises four guiding wings, wherein said four flat portions of said four guiding wings are integrally and perpendicularly connected with each other to form a cross shape.

3. A gas vortex device for an internal combustion engine, comprising a predetermined number of guider bodies installed in a predetermined position of a flowing passage provided between a cylinder body and an exhaling end of an air inputting arrangement of said internal combustion engine, in which said guider body, which has an inlet end and an outlet end, is installed in a manner that said outlet end is more proximate to an inlet chamber of said cylinder body than said inlet end, said guider body further having an axial portion and at least two guiding wings extending symmetrically, outwardly and radially from said axial portion, wherein each of said guiding wings is a flat plate symmetrically extending and bending from said inlet end to said outlet end of said guider body with a predetermined angle to form a flat portion and an inclined portion, said flat portion of each said guiding wing having a same length and width to constitute said inlet end of said guiding body and said inclined portion of each said guiding wing being extended from a rear end of said corresponding flat portion and bent gradually to form an inclined arc shape to constitute said outlet end of said guiding body, each said inclined portion of said guiding wings gradually decreasing a width thereof from said corresponding flat portion to form a narrower tail end so as to enable said guider body to be coaxially mounted on a predetermined position of said flowing passage, said flowing passage having a cylindrical inner wall and being constituted by an exit tube of a carburetor which is mounted underneath said air inputting arrangement, a predetermined number of inlet chambers of said cylinder body and an inlet manifold for connecting said exit tube with said inlet chambers, each said inlet chamber of said cylinder body having a circular entrance opening, said predetermined number of said guider bodies being installed in said inlet chambers respectively, said circular entrance opening having a top circumference forming a predetermined number of equally spaced indentions, an outermost side of each said flat portion of each said guiding wing of said guider body protruding a supporting shoulder for engaging in said indentions of said top circumference of said circular entrance opening of each said inlet chamber respectively, thereby a gas mixture including air and atomized fuel particles that are sucked into said flowing passage from said air inputting arrangement are forced to flow through said guider body, inhaling through said inlet end and exhaling from said outlet end of said guider body, so that said gas mixture is guided by said guiding wings to spin and exhaled from said outlet end in form of vortical flow, so as to further diminish said atomized fuel particles and mix said air and said atomized fuel particles more completely and evenly.

4. A gas vortex device for an internal combustion engine, as recited in claim 3, in which said guider body comprises four guiding wings, wherein said four flat portions of said four guiding wings are integrally and perpendicularly connected with each other to form a cross shape.

* * * * *